US011939741B2

(12) United States Patent
Vandegrift et al.

(10) Patent No.: US 11,939,741 B2
(45) Date of Patent: Mar. 26, 2024

(54) APPARATUS AND METHOD FOR CONTROLLING AN ATTACHMENT COUPLER FOR A WORK VEHICLE

(71) Applicant: DEERE & COMPANY, Moline, IL (US)

(72) Inventors: Alex R. Vandegrift, Dubuque, IA (US); John R. Mahrenholz, Dubuque, IA (US); Todd F. Velde, Dubuque, IA (US); Benjamin Morrison, Dubuque, IA (US); Bryan Rausch, Durango, IA (US); Megan E. Marotz, Dubuque, IA (US); Christopher J. Meyer, Dubuque, IA (US)

(73) Assignee: Deere & Company, Moline, IL (US)

( * ) Notice: Subject to any disclaimer, the term of this patent is extended or adjusted under 35 U.S.C. 154(b) by 1185 days.

(21) Appl. No.: 16/665,752

(22) Filed: Oct. 28, 2019

(65) Prior Publication Data

US 2021/0123207 A1 Apr. 29, 2021

(51) Int. Cl.

| | |
|---|---|
| ***E02F 3/84*** | (2006.01) |
| ***E02F 3/34*** | (2006.01) |
| ***E02F 3/43*** | (2006.01) |
| ***E02F 3/76*** | (2006.01) |

(Continued)

(52) U.S. Cl.

CPC ..... *E02F 3/431* (2013.01); *E02F 3/3414* (2013.01); *E02F 3/434* (2013.01); *E02F 3/7622* (2013.01); *E02F 3/844* (2013.01); *E02F 3/96* (2013.01); *E02F 9/2004* (2013.01); *E02F 9/2041* (2013.01); *E02F 9/2271* (2013.01); *E02F 9/264* (2013.01)

(58) Field of Classification Search

CPC ..... E02F 3/431; E02F 3/3414; E02F 3/434; E02F 3/7622; E02F 3/844; E02F 3/96;

(Continued)

(56) References Cited

U.S. PATENT DOCUMENTS 7,293,376 B2 * 11/2007 Glover ..... E02F 3/847 701/50
8,103,417 B2 * 1/2012 Gharsalli ..... E02F 3/844 318/587

(Continued)

FOREIGN PATENT DOCUMENTS

DE 4442689 A1 6/1995

OTHER PUBLICATIONS

German Search Report issued in application No. DE102020211562.1 dated Jun. 17, 2021 (10 pages).

*Primary Examiner* — Edwin J Toledo-Duran

(57) ABSTRACT

A work vehicle comprising a frame supported by a ground engaging device. A boom assembly is coupled to the frame. An attachment coupler is coupled to the boom assembly. An electronic data processor is communicatively coupled to a boom actuator, an attachment coupler actuator, a boom sensor, an attachment coupler sensor, and an operator input device. A computer readable storage medium comprising machine readable instructions that, when executed by the processor, cause the processor to receive an operator input and for a tilt forward command, command the boom actuator to move the boom assembly to a frame contact position and then command the attachment coupler actuator to move the attachment coupler towards a lower position. For a tilt rearward command, command the attachment coupler actuator to move the attachment coupler towards an upper position and then command the boom actuator to move the boom assembly towards a raised position.

14 Claims, 11 Drawing Sheets

(51) Int. Cl.

| | |
|---|---|
| ***E02F 3/96*** | (2006.01) |
| ***E02F 9/20*** | (2006.01) |
| ***E02F 9/22*** | (2006.01) |
| ***E02F 9/26*** | (2006.01) |

(58) Field of Classification Search

CPC ..... E02F 9/2004; E02F 9/2041; E02F 9/2271; E02F 9/264; E02F 9/2012; E02F 3/432; E02F 3/437; E02F 9/265; E02F 3/40; E02F 3/36; E02F 3/3604; E02F 3/42; E02F 3/43; E02F 3/80; E02F 3/815; E02F 3/84; E02F 3/845; E02F 3/7618; E02F 3/841; E02F 3/842; E02F 8/847; E02F 3/7631; E02F 3/7627

See application file for complete search history.

(56) References Cited

U.S. PATENT DOCUMENTS

| | | | | |
|---|---|---|---|---|
| 8,118,111 | B2 | 2/2012 | Armas | |
| 8,548,690 | B2 * | 10/2013 | Hayashi | E02F 3/847 701/50 |
| 9,328,479 | B1 * | 5/2016 | Rausch | E02F 9/265 |
| 9,624,643 | B2 * | 4/2017 | Hendron | E02F 3/847 |
| 9,752,300 | B2 * | 9/2017 | Chang | E02F 3/7627 |
| 10,385,541 | B2 * | 8/2019 | Dean | E02F 3/433 |
| 10,533,300 | B1 | 1/2020 | Armas | |
| 2002/0162668 | A1 * | 11/2002 | Carlson | E02F 9/26 172/1 |
| 2004/0136821 | A1 | 7/2004 | Berger et al. | |
| 2009/0183886 | A1 | 7/2009 | Armas | |
| 2010/0215469 | A1 * | 8/2010 | Trifunovic | E02F 3/432 414/699 |
| 2011/0153170 | A1 * | 6/2011 | Dishman | E02F 9/2029 701/50 |
| 2011/0213529 | A1 * | 9/2011 | Krause | E02F 3/431 701/50 |
| 2012/0165962 | A1 | 6/2012 | Faivre | |
| 2013/0274925 | A1 | 10/2013 | Oates, Jr. et al. | |
| 2015/0275469 | A1 | 10/2015 | Fredrickson et al. | |
| 2017/0114523 | A1 | 4/2017 | Horstman et al. | |
| 2018/0245306 | A1 | 8/2018 | Lewis | |
| 2019/0226176 | A1 * | 7/2019 | Smith | E02F 3/432 |
| 2019/0257057 | A1 | 8/2019 | Eckrote | |

* cited by examiner

330

A method for controlling the operation of an attachment coupler coupled to a boom assembly of a work vehicle. The method comprises providing an attachment coupled to the attachment coupler. The method comprises providing an electronic data processor communicatively coupled to a boom actuator configured to move the boom assembly, an attachment coupler actuator configured to move the attachment coupler, and an attachment actuator configured to rotate the attachment relative to the attachment coupler.

335

The method further comprises generating a boom signal indicative of a position of the boom assembly with a boom sensor.

340

The method comprises generating an attachment signal indicative of a position of the attachment coupler with an attachment coupler sensor.

345

The method further comprises receiving an operator input from an operator input device configured for receiving the operator input in a first mode or a second mode. The operator input in the first mode comprising at least one of the tilt forward command, the tilt rearward command, a rotate right command, or a rotate left command, and the operator input in the second mode comprising at least one of a boom lower command, a boom raise command, the tilt forward command, or the tilt rearward command.

350

The method comprises receiving the boom signal, the attachment signal, and the operator input with the electronic data processor.

355

The method further comprises providing a computer readable storage medium comprising machine readable instructions that, when executed by the electronic data processor, cause the electronic data processor to receive the operator input and, in the first mode, for the tilt forward command, command the boom actuator to move the boom assembly to the frame contact position and then command the attachment coupler actuator to move the attachment coupler towards the lower position. For the tilt rearward command, command the attachment coupler actuator to move the attachment coupler towards the upper position and then command the boom actuator to move the boom assembly towards the raised position. For the rotate right command, command at least one attachment actuator, coupled to the attachment and configured to rotate the attachment relative to the attachment coupler, to rotate the attachment towards the right. For the rotate left command, command the attachment actuator to rotate the attachment towards the left. In the second mode, for the boom lower command, command the boom actuator to move the boom assembly towards the frame contact position. For the boom raise command, command the boom actuator to move the boom assembly towards the raised position. For the tilt forward command, command the attachment coupler actuator to tilt the attachment coupler towards the lower position. For the tilt rearward command, command the attachment coupler actuator to tilt the attachment coupler towards the upper position.

FIG. 10

360

A method for controlling the operation of an attachment coupler coupled to a boom assembly of a work vehicle. The method comprises providing an attachment coupled to the attachment coupler. The method comprises providing an electronic data processor communicatively coupled to a boom actuator configured to move the boom assembly, an attachment coupler actuator configured to move the attachment coupler, and an attachment actuator configured to rotate the attachment relative to the attachment coupler.

365

The method further comprises generating a boom signal indicative of a position of the boom assembly with a boom sensor.

370

The method comprises generating an attachment signal indicative of a position of the attachment coupler with an attachment coupler sensor.

375

The method further comprises receiving an operator input from an operator input device configured for receiving the operator input in a first mode or a second mode. The operator input in the first mode comprising at least one of the tilt forward command, the tilt rearward command, a rotate right command, or a rotate left command, and the operator input in the second mode comprising at least one of a boom lower command, a boom raise command, the tilt forward command, or the tilt rearward command.

380

The method comprises receiving the boom signal, the attachment signal, and the operator input with the electronic data processor.

385

The method further comprises providing a computer readable storage medium comprising machine readable instructions that, when executed by the electronic data processor, cause the electronic data processor to receive the operator input and, in the first mode, for the tilt forward command, command the boom actuator to move the boom assembly to the frame contact position and then command the attachment coupler actuator to move the attachment coupler to the predetermined lower position while preventing the attachment coupler from moving to the lower position, for the tilt rearward command, command the attachment coupler actuator to move the attachment coupler to the predetermined upper position and then command the boom actuator to move the boom assembly to the raised position, for the rotate right command, command the attachment actuator to rotate the attachment coupler towards the right, for the rotate left command, command the attachment actuator to rotate the attachment coupler towards the left and, in the second mode, for the boom lower command, command the boom actuator to move the boom assembly lower, for the boom raise command, command the boom actuator to move the boom assembly higher, for the tilt forward command, command the attachment coupler actuator to tilt the attachment coupler forward, for the tilt rearward command, command the attachment coupler actuator to tilt the attachment coupler rearward.

FIG. 11

APPARATUS AND METHOD FOR CONTROLLING AN ATTACHMENT COUPLER FOR A WORK VEHICLE

FIELD OF THE DISCLOSURE

The present disclosure generally relates to work vehicles, such as skid steers, compact track loaders, and more particularly to an apparatus and method for controlling the operation of an attachment coupler of a work vehicle.

BACKGROUND OF THE DISCLOSURE

In order to control an attachment coupler coupled to a variety of attachments having pitch, tilt, and angle adjustment, multiple setting changes are commonly required to an operator input device.

SUMMARY OF THE DISCLOSURE

In one embodiment, a work vehicle is disclosed. The work vehicle comprises a frame. At least one ground engaging device is coupled to the frame and configured to support the frame above a surface. A boom assembly is coupled to the frame. The boom assembly is configured to move from a frame contact position to a raised position. At least one boom actuator is coupled to the boom assembly and configured to move the boom assembly. An attachment coupler is coupled to the boom assembly. The attachment coupler is configured to move from a lower position to an upper position. At least one attachment coupler actuator is coupled to the attachment coupler and configured to move the attachment coupler. A boom sensor is configured to generate a boom signal indicative of a position of the boom assembly. An attachment coupler sensor is configured to generate an attachment signal indicative of a position of the attachment coupler. An operator input device is configured for receiving an operator input in at least one mode. An electronic data processor is communicatively coupled to the boom actuator, the attachment coupler actuator, the boom sensor, the attachment coupler sensor, and the operator input device. The electronic data processor is configured to receive the boom signal, the attachment signal, and the operator input. A computer readable storage medium comprising machine readable instructions that, when executed by the electronic data processor, cause the electronic data processor to receive the operator input and for a tilt forward command, command the boom actuator to move the boom assembly to the frame contact position and then command the attachment coupler actuator to move the attachment coupler towards the lower position. For a tilt rearward command, command the attachment coupler actuator to move the attachment coupler towards the upper position and then command the boom actuator to move the boom assembly towards the raised position.

In another embodiment, a method for controlling the operation of an attachment coupler coupled to a boom assembly of a work vehicle is disclosed. The method comprises providing an electronic data processor communicatively coupled to a boom actuator configured to move the boom assembly and an attachment coupler actuator configured to move the attachment coupler. The method further comprises generating a boom signal indicative of a position of the boom assembly with a boom sensor. The method comprises generating an attachment signal indicative of a position of the attachment coupler with an attachment coupler sensor. The method further comprises receiving an operator input from an operator input device configured for receiving the operator input in at least one mode. The method further comprises receiving the boom signal, the attachment signal, and the operator input with the electronic data processor. The method comprises providing a computer readable storage medium comprising machine readable instructions that, when executed by the electronic data processor, cause the electronic data processor to receive the operator input and for a tilt forward command, command the boom actuator to move the boom assembly to a frame contact position and then command the attachment coupler actuator to move the attachment coupler towards a lower position, for a tilt rearward command, command the attachment coupler actuator to move the attachment coupler towards an upper position and then command the boom actuator to move the boom assembly towards a raised position.

In yet another embodiment, a compact track loader comprises a frame. At least one ground engaging device is coupled to the frame and configured to support the frame above a surface. A boom assembly is coupled to the frame. The boom assembly is configured to move from a frame contact position to a raised position. At least one boom actuator is coupled to the boom assembly and configured to move the boom assembly. An attachment coupler is coupled to the boom assembly. The attachment coupler is configured to move from a lower position to an upper position. At least one attachment coupler actuator is coupled to the attachment coupler and configured to move the attachment coupler. An attachment is coupled to the attachment coupler. The attachment is configured to rotate relative to the attachment coupler. An attachment actuator is coupled to the attachment and configured to move the attachment. A boom sensor is configured to generate a boom signal indicative of a position of the boom assembly. An attachment coupler sensor is configured to generate an attachment signal indicative of a position of the attachment coupler. An operator input device is configured for receiving an operator input in at least one mode. An electronic data processor is communicatively coupled to the boom actuator, the attachment coupler actuator, the attachment actuator, the boom sensor, the attachment coupler sensor, and the operator input device. The electronic data processor is configured to receive the boom signal, the attachment signal, and the operator input. A computer readable storage medium comprising machine readable instructions that, when executed by the electronic data processor, cause the electronic data processor to receive the operator input and for a tilt forward command, command the boom actuator to move the boom assembly to the frame contact position and then command the attachment coupler actuator to move the attachment coupler towards the lower position. For a tilt rearward command, command the attachment coupler actuator to move the attachment coupler towards the upper position and then command the boom actuator to move the boom assembly towards the raised position.

Other features and aspects will become apparent by consideration of the detailed description and accompanying drawings.

BRIEF DESCRIPTION OF THE DRAWINGS

FIG. 10 is a schematic of an illustrative method for controlling the work vehicle of FIG. 1.

FIG. 11 is a schematic of an illustrative method for controlling the work vehicle of FIG. 1 according to another embodiment.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

As used herein, unless otherwise limited or modified, lists with elements that are separated by conjunctive terms (e.g., "and") and that are also preceded by the phrase "at least one of" or "one or more of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

DETAILED DESCRIPTION

Figure 1:
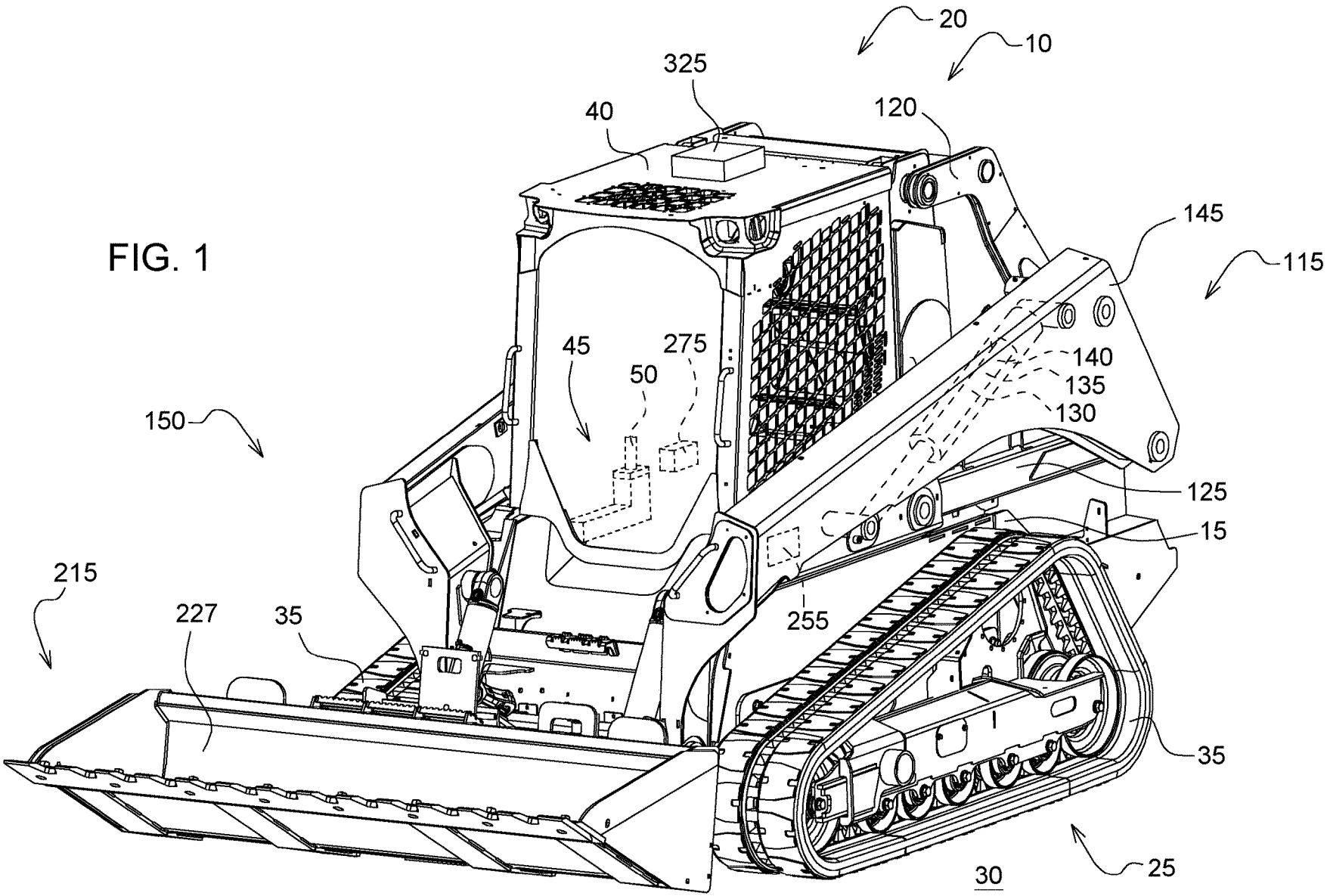
FIG. 1 is a perspective view of a work vehicle with an attachment coupler.

FIG. 1 illustrates a work vehicle 10 having a frame 15. The work vehicle 10 is illustrated as a compact track loader 20. Other types of work vehicles 10 are contemplated by this disclosure including skid steers and bulldozers, for example. At least one ground engaging device 25 is coupled to the frame 15 and configured to support the frame 15 above a surface 30 and to move the work vehicle 10 along the surface 30. The illustrated ground engaging device 25 is a pair of tracks 35. Alternatively, the ground engaging device 25 may be wheels (not shown).

An operator's station 40 is coupled to the frame 15. The operator's station 40 may have a door (not shown). An operator input device 45 may be positioned in the operator's station 40.

Figure 7:
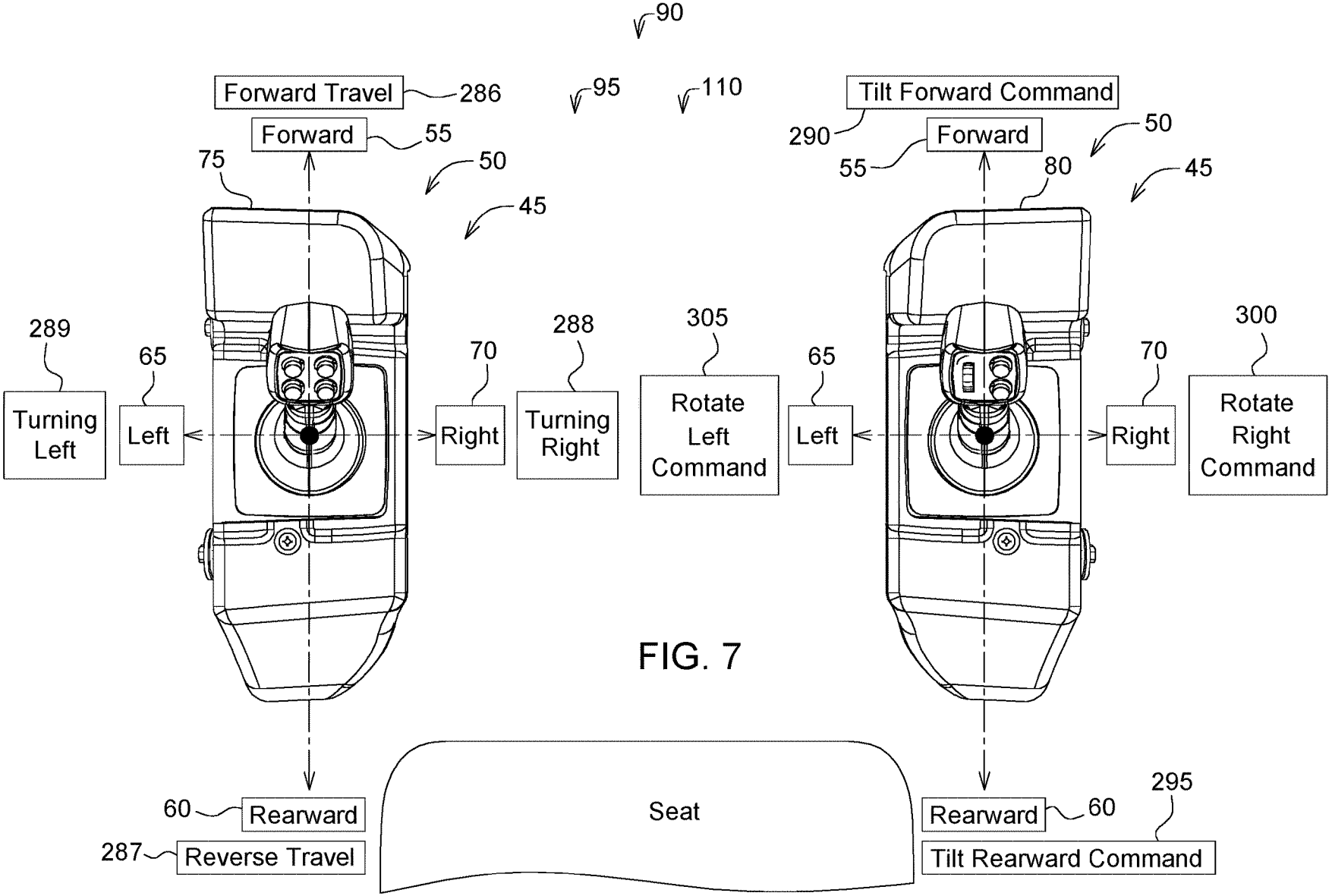
FIG. 7 is a schematic of an operator input device of the work vehicle of FIG. 1 in a first mode.
Figure 8:
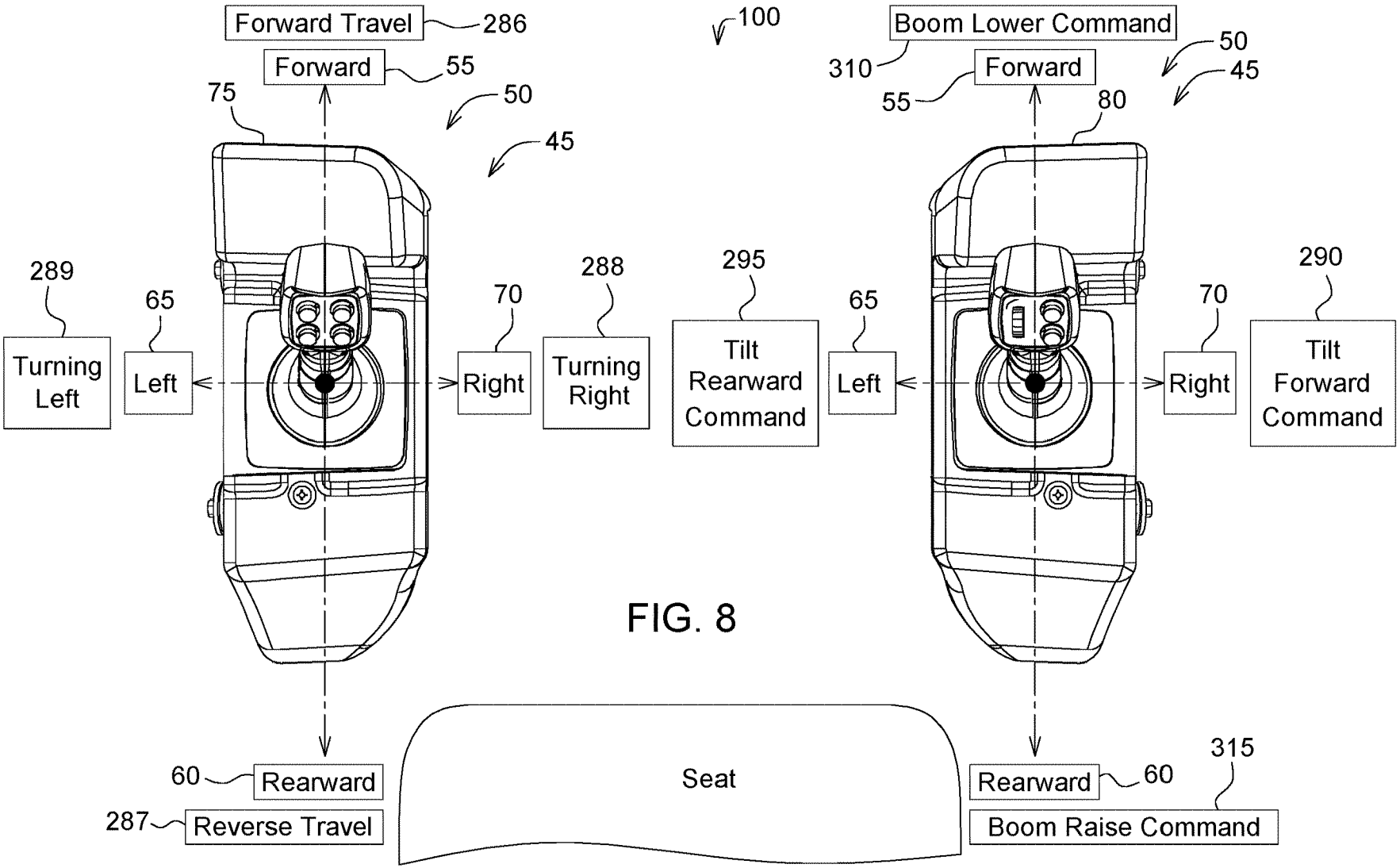
FIG. 8 is a schematic of an operator input device of the work vehicle of FIG. 1 in a second mode.

With reference to FIGS. 7 and 8, the operator input device 45 may be a joystick 50 configured for movement in at least a forward 55, a rearward 60, a left 65, and a right 70 direction. Alternatively, the joystick 50 may be a first joystick 75 and a second joystick 80.

Figure 9:
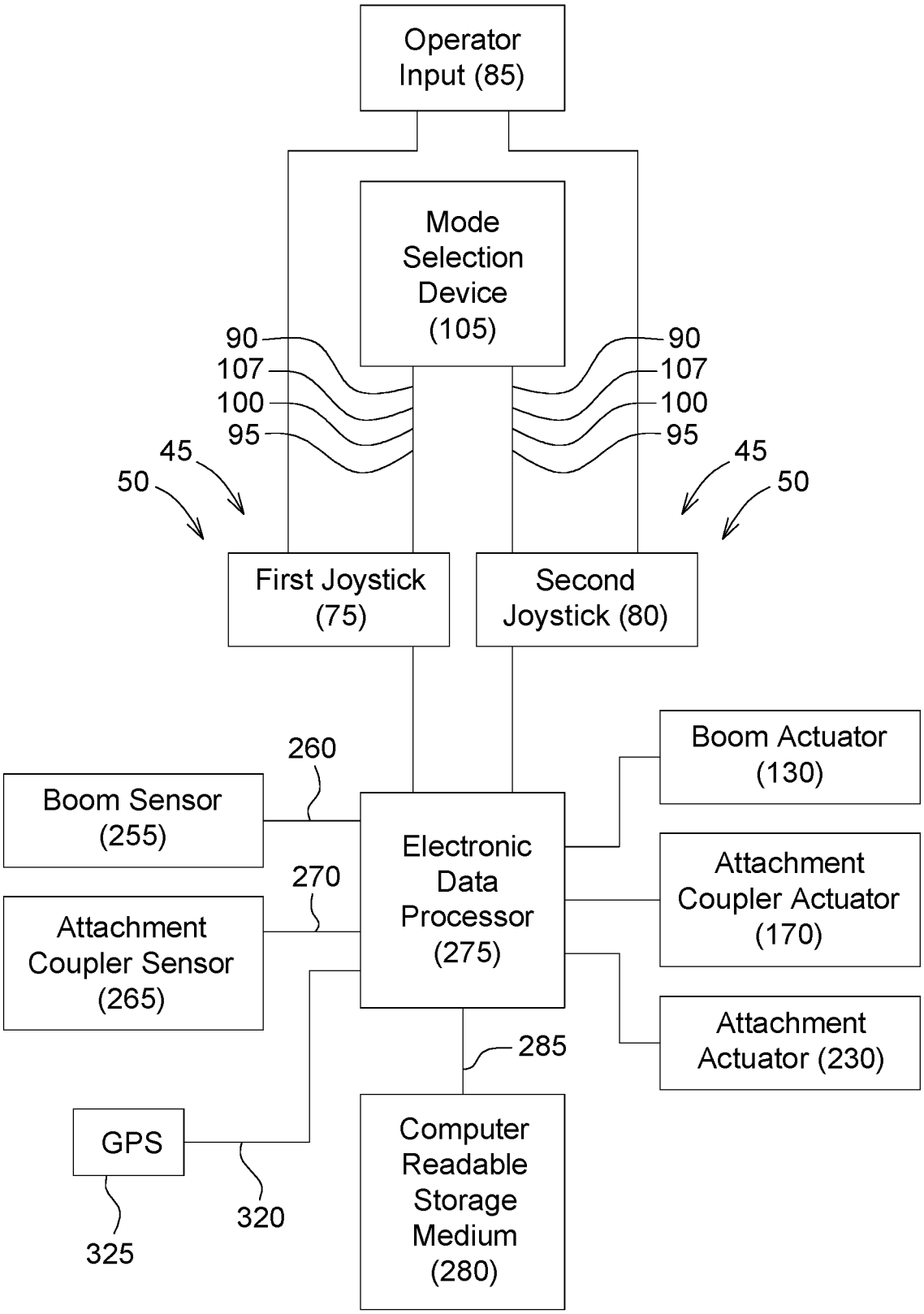
FIG. 9 is a schematic of the work vehicle of FIG. 1.

Referring to FIGS. 7-9, the operator input device 45 may be configured for receiving an operator input 85 in at least one mode 90. The operator input device 45 may be configured for receiving the operator input 85 in a first mode 95 (FIG. 7) and a second mode 100 (FIG. 8). A mode selection device 105 may be communicatively coupled to the operator input device 45 and configured to switch between the first mode 95, the second mode 100, and an automatic blade control mode 107. The first mode 95 may be a dozer control mode 110 with controls that resemble those normally attributed to a dozer/crawler (not shown).

Figure 4:
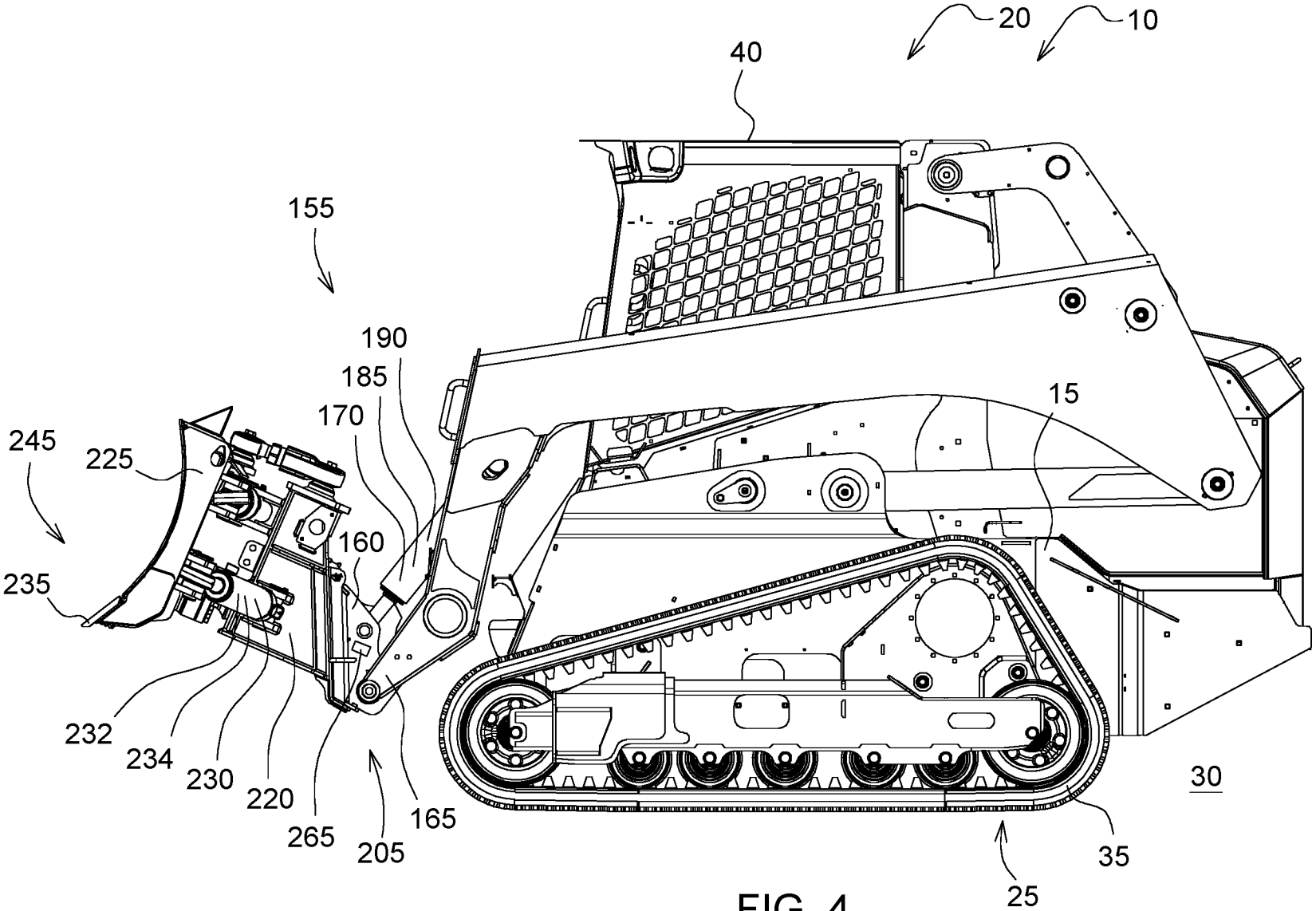
FIG. 4 is a zoomed in side view of the work vehicle of FIG. 1, showing a boom assembly in a raised position.

With reference to FIG. 1, a boom assembly 115 is coupled to the frame 15. The boom assembly 115 comprises a pair of upper links 120 that are coupled to the frame 15. A pair of lower links 125 are coupled to the frame 15. A pair of boom actuators 130 are coupled to the frame 15 with one per side of the work vehicle 10. The boom actuators 130 may be hydraulic actuators 135 or electronic actuators 140. A pair of boom arms 145 are coupled to the upper links 120 and the lower links 125 and positioned one per side of the work vehicle 10. The pair of boom arms 145 are coupled to the boom actuators 130. The boom actuators 130 are configured to move the boom assembly 115 from a frame contact position 150 to a raised position 155 (FIG. 4).

Figure 2:
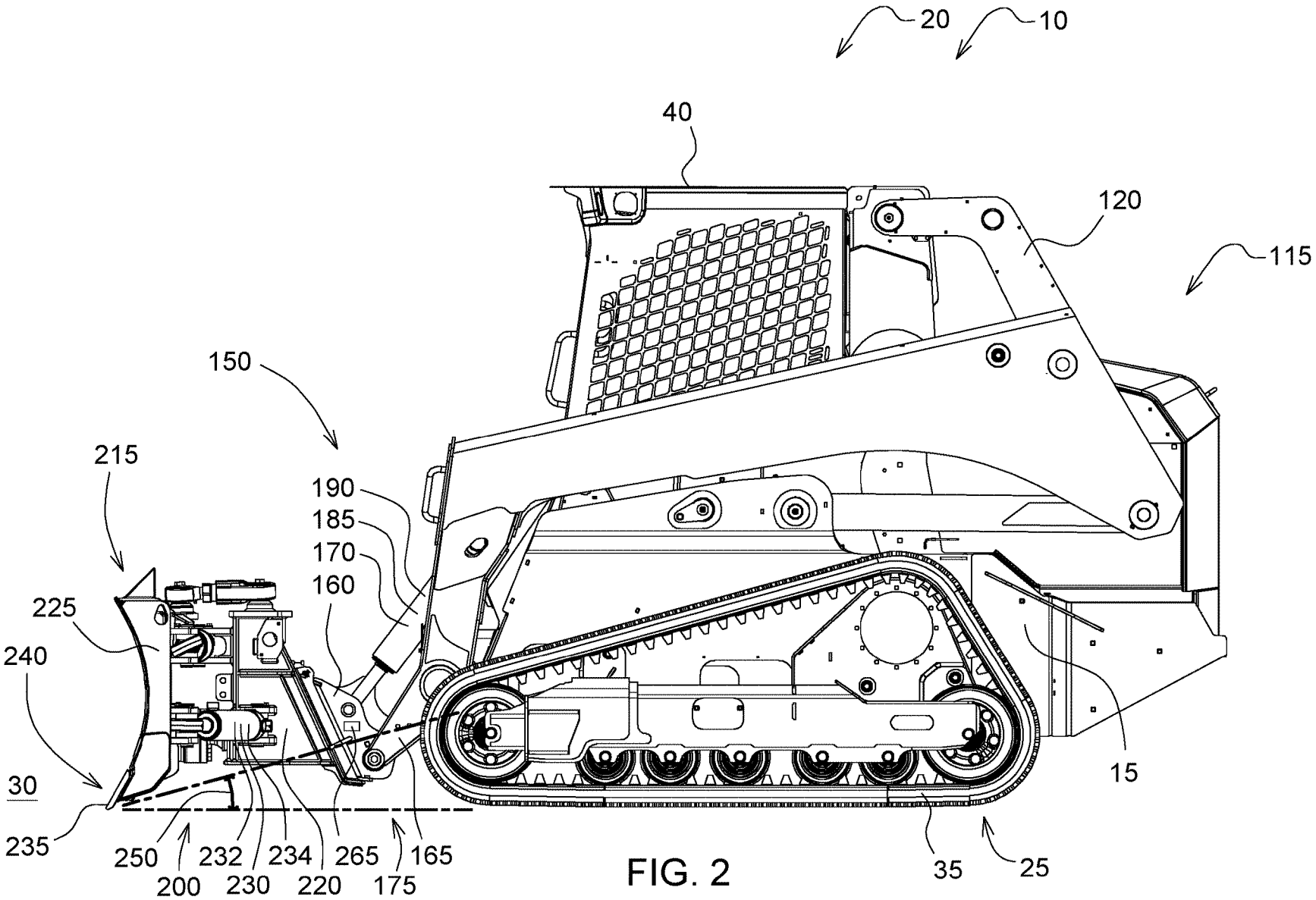
FIG. 2 is a zoomed in side view of the work vehicle of FIG. 1, showing the attachment coupler in a lower position.
Figure 3:
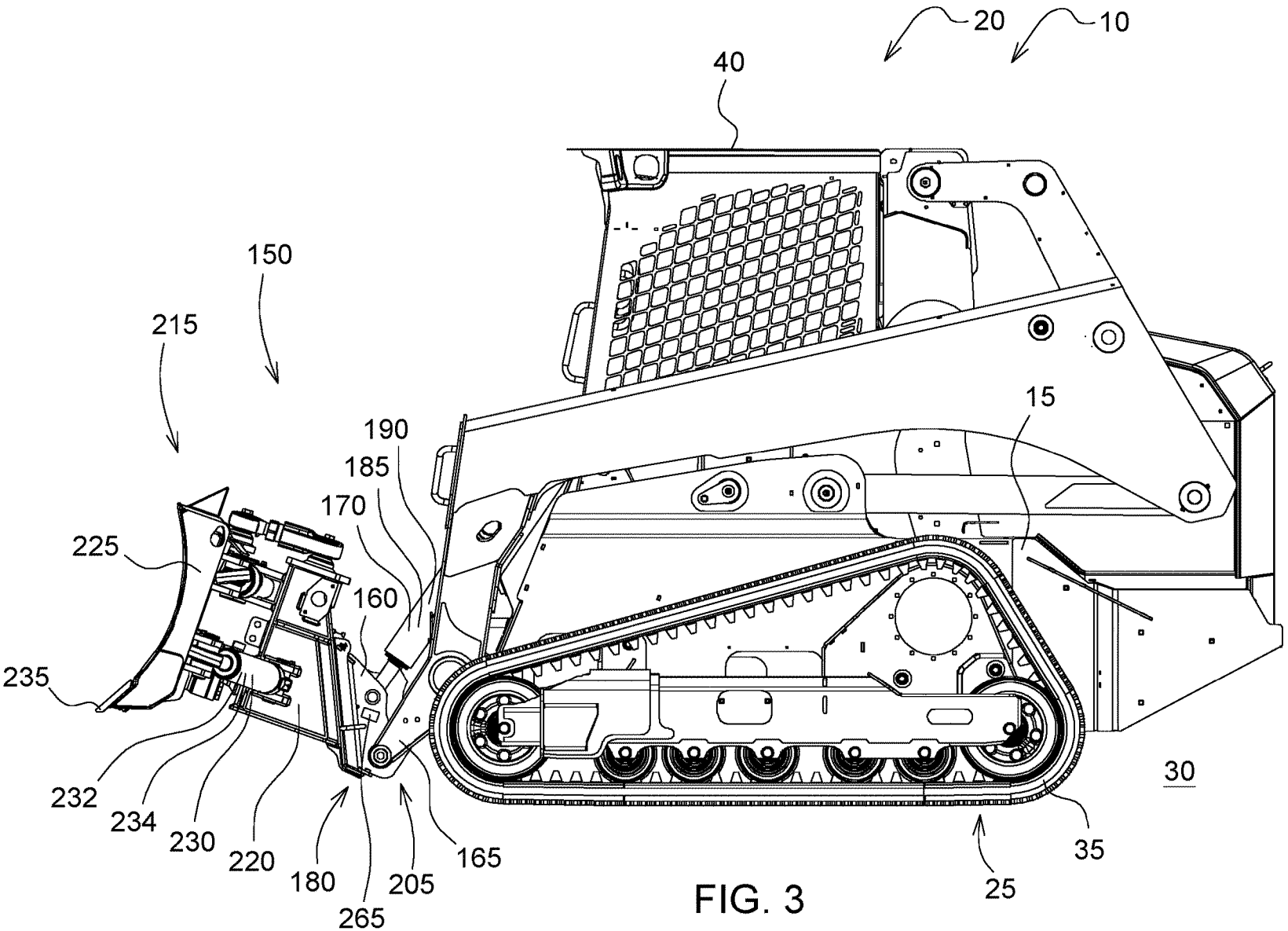
FIG. 3 is a zoomed in side view of the work vehicle of FIG. 1, showing the attachment coupler in an upper position.
Figure 5:
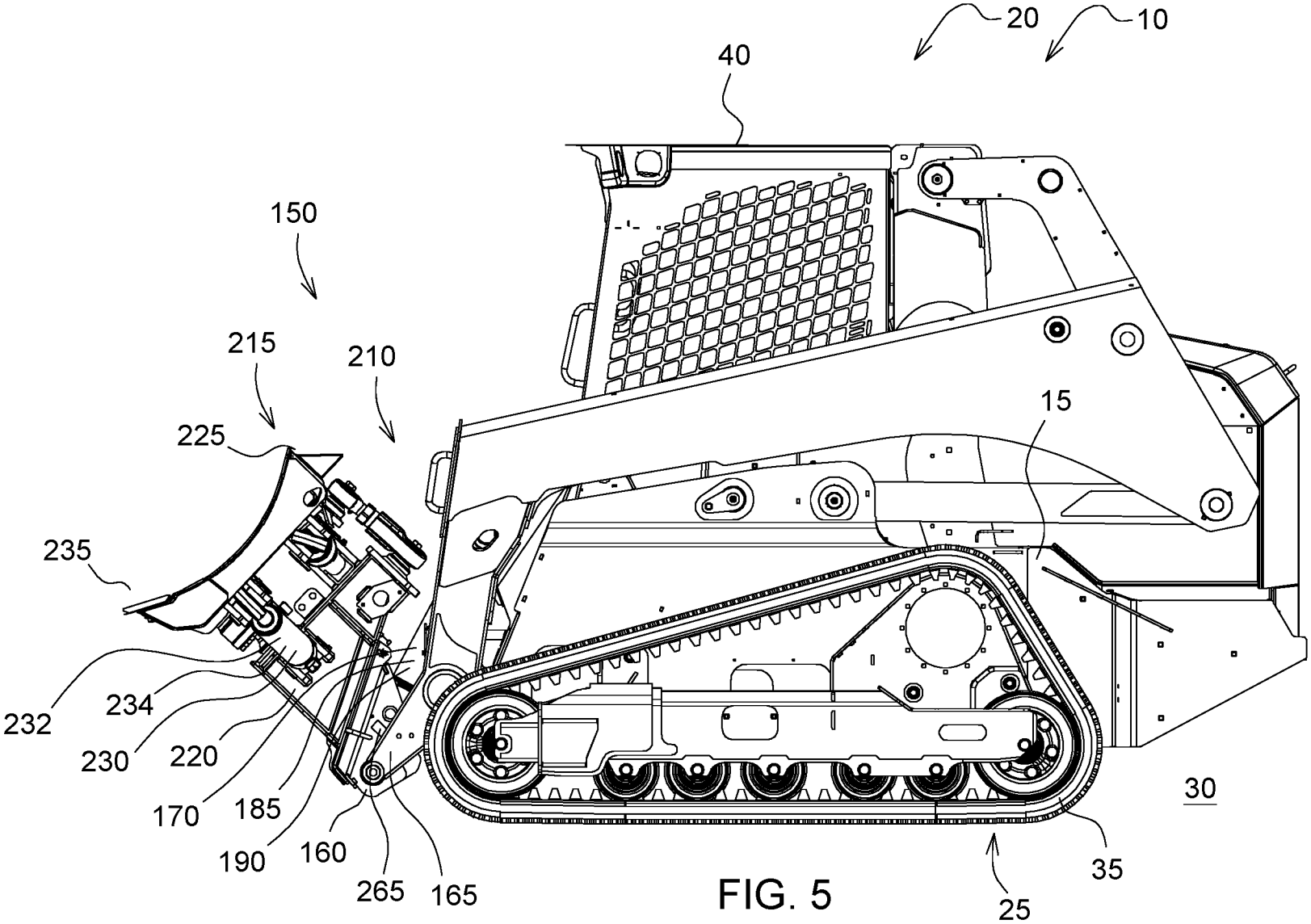
FIG. 5 is a zoomed in side view of the work vehicle of FIG. 1, showing the attachment coupler in a fully retracted position.
Figure 6:
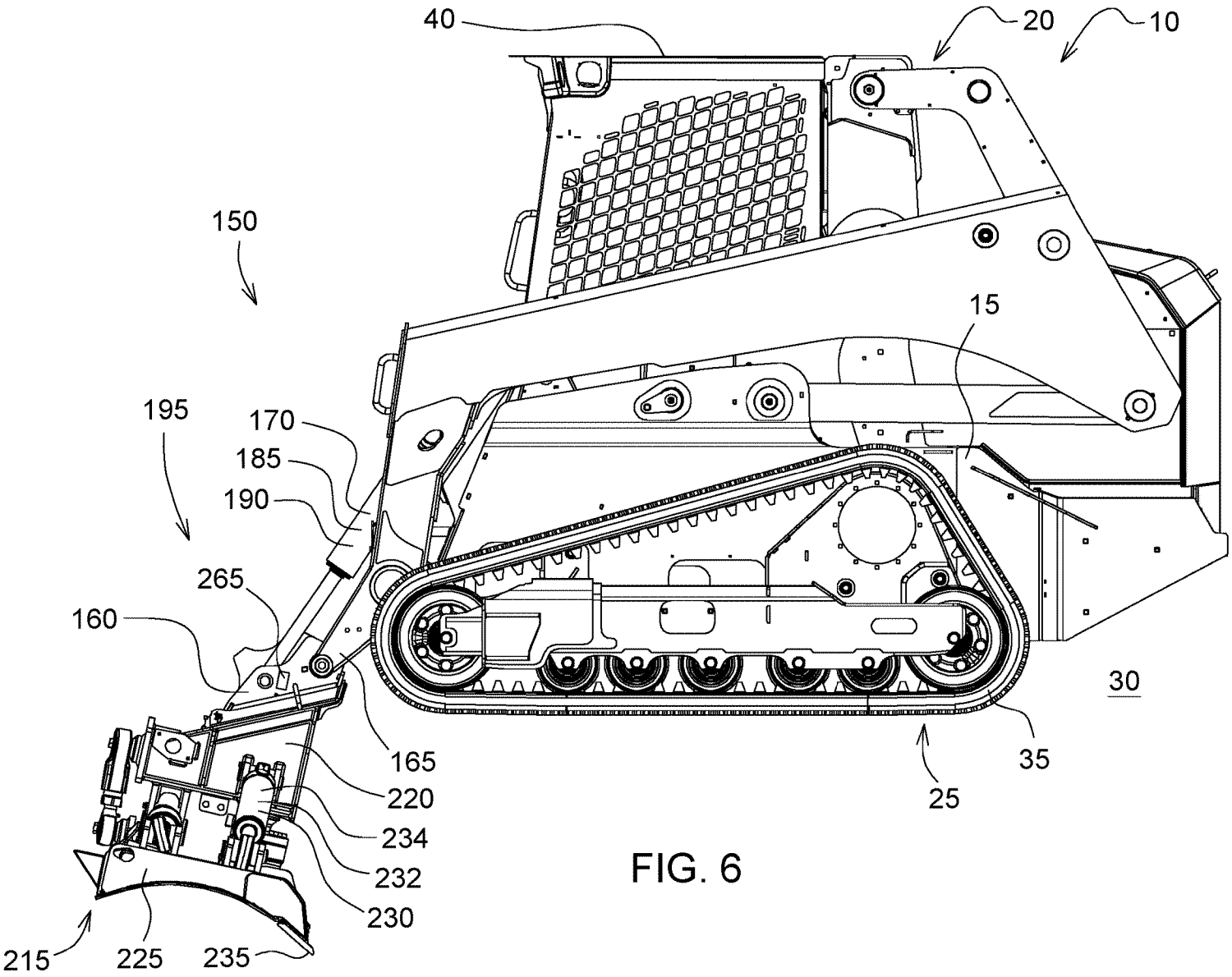
FIG. 6 is a zoomed in side view of the work vehicle of FIG. 1, showing the attachment coupler in a fully extended position.

Referring to FIGS. 2-6, an attachment coupler 160 is coupled to a distal portion 165 of the boom assembly 115. At least one attachment coupler actuator 170 is coupled to the boom assembly 115 and the attachment coupler 160 and configured to move the attachment coupler 160 from a lower position 175 (FIG. 2) to an upper position 180 (FIG. 3). The attachment coupler actuator 170 may be a hydraulic actuator 185 or an electronic actuator 190. The attachment coupler 160 and the attachment coupler actuator 170 have a fully extended position 195 (FIG. 6), a predetermined lower position 200 (FIG. 2), a predetermined upper position 205 (FIG. 3), and a fully retracted position 210 (FIG. 5).

An attachment 215 is coupled to the attachment coupler 160. The attachment 215 comprises an attachment frame 220 coupled to the attachment coupler 160. A dozer blade 225 or a bucket 227 (FIG. 1) may be coupled to the attachment frame 220. An attachment actuator 230 is coupled to the dozer blade 225 of the attachment 215 and configured to rotate the attachment 215 relative to the attachment coupler 160. The attachment actuator may be a hydraulic actuator 232 or an electronic actuator 234. The attachment 215 may have a cutting edge 235, a desired cutting edge position 240 (FIG. 2), and a desired material pushing position 245 (FIG. 4). The cutting edge 235 may be positioned at an angle 250 relative to the frame 15 (FIG. 2).

With reference to FIG. 1, a boom sensor 255 may be coupled to the boom assembly 115. The boom sensor 255 is configured to generate a boom signal 260 (FIG. 9) indicative of a position of the boom assembly 115.

Referring to FIG. 2, an attachment coupler sensor 265 may be coupled to the attachment coupler 160. The attachment coupler sensor 265 is configured to generate an attachment signal 270 (FIG. 9) indicative of a position of the attachment coupler 160.

With reference to FIG. 9, an electronic data processor 275 may be coupled to the operator's station 40 or elsewhere on the work vehicle 10. The electronic data processor 275 may be communicatively coupled to the boom actuator 130, the attachment coupler actuator 170, the attachment actuator 230, the boom sensor 255, the attachment coupler sensor 265, and the operator input device 45. The electronic data processor 275 is configured to receive the boom signal 260, the attachment signal 270, and the operator input 85. A computer readable storage medium 280 comprises machine readable instructions 285 that, when executed by the electronic data processor 275, may cause the electronic data processor 275 to receive the operator input 85.

Referring to FIG. 7, in the mode 90, the first mode 95, and the dozer mode 110, the first joystick 75 is manipulated forward 55 for forward travel 286, manipulated rearward 60 for reverse travel 287, manipulated right 70 for turning right 288, and manipulated left 65 for turning left 289. The second joystick 80 is manipulated forward 55 for the tilt forward command 290, manipulated rearward 60 for the tilt rearward command 295, manipulated right 70 for the rotate right command 300, and manipulated left 65 for the rotate left command 305.

In mode 90, the first mode 95, and the dozer mode 110, for the tilt forward command 290, the boom actuator 130 is commanded to move the boom assembly 115 to the frame contact position 150 and then the attachment coupler actuator 170 is commanded to move the attachment coupler 160 towards the lower position 175. For the tilt rearward command 295, the attachment coupler actuator 170 is commanded to move the attachment coupler 160 towards the upper position 180 and then the boom actuator 130 is commanded to move the boom assembly 115 towards the raised position 155. For the rotate right command 300, the attachment actuator 230 is commanded to rotate the attachment 215 towards the right 70. For the rotate left command 305, the attachment actuator 230 is commanded to rotate the attachment 215 towards the left 65.

With reference to FIG. 8, in the second mode 100, the first joystick 75 is manipulated forward 55 for forward travel 286, manipulated rearward 60 for reverse travel 287, manipulated right 70 for turning right 288, and manipulated left 65 for turning left 289. The second joystick 80 is manipulated forward 55 for the boom lower command 310, manipulated rearward 60 for the boom raise command 315, manipulated right 70 for the tilt forward command 290, and manipulated left 65 for the tilt rearward command 295.

In the second mode 100, for the boom lower command 310, the boom actuator 130 is commanded to move the boom assembly 115 towards the frame contact position 150. For the boom raise command 315, the boom actuator 130 is commanded to move the boom assembly 115 towards the raised position 155. For the tilt forward command 290, the attachment coupler actuator 170 is commanded to tilt the attachment coupler 160 towards the lower position 175, for the tilt rearward command 295, command the attachment coupler actuator 170 to tilt the attachment coupler 160 towards the upper position 180.

Alternatively in another embodiment, referring to FIGS. 7 and 9, the computer readable storage medium 280 comprises machine readable instructions 285 that, when executed by the electronic data processor 280, cause the electronic data processor 280 to receive the operator input 85 and, in the first mode 95, for the tilt forward command 290, the boom actuator 130 is commanded to move the boom assembly 115 to the frame contact position 150 and then the attachment coupler actuator 170 is commanded to move the attachment coupler 160 to the predetermined lower position 200 while preventing the attachment coupler 160 from moving to the lower position 175. For the tilt rearward command 295, the attachment coupler actuator 170 is commanded to move the attachment coupler 160 to the predetermined upper position 205 while preventing the attachment coupler 160 from moving to the upper position 180 and then the boom actuator 130 is commanded to move the boom assembly 115 to the raised position 155. For the rotate right command 300, the attachment actuator 230 is commanded to rotate the attachment coupler 160 towards the right 70. For the rotate left command 305, the attachment actuator 230 is commanded to rotate the attachment coupler 160 towards the left 65.

Referring to FIG. 8, in another embodiment in the second mode 100, for the boom lower command 310, the boom actuator 130 is commanded to move the boom assembly 115 lower or towards the frame contact position 150. For the boom raise command 315, the boom actuator 130 is commanded to move the boom assembly 115 higher or towards the raised position 155. For the tilt forward command 290, the attachment coupler actuator 170 is commanded to tilt the attachment coupler 160 forward or towards the lower position 175. For the tilt rearward command 295, the attachment coupler actuator 170 is commanded to tilt the attachment coupler 160 rearward or towards the upper position 180.

With reference to FIG. 2, at the predetermined lower position 200, a cutting edge 235 of the attachment 215 or dozer blade 225 may be at a desired cutting edge position 240. Referring to FIG. 4, at the predetermined upper position 205, a cutting edge 235 of the attachment 215 or dozer blade 225 may be at a desired material pushing position 245. With reference to FIG. 2, an angle 250 of the cutting edge 235 of the attachment 215 relative to the frame 15 may be maintained from the predetermined lower position 200 to the predetermined upper position 205.

Referring to FIGS. 1 and 9, the work vehicle 10 may have the automatic blade control mode 107 where the attachment 215 is automatically controlled by the electronic data processor 275 that receives location signals 320 from a global positioning system or GPS 325. In the automatic blade control mode 107, the attachment 215 may be controlled to remain at the same angle 250 and position via GPS 325 relative to the frame 15 or the surface 30. For example, the attachment 215 may be kept at a constant grade by automatically moving the position of the attachment coupler 160 between the lower position 175 and the upper position 180. The electronic data processor 275 is configured to turn off the automatic blade control mode 107 when the boom assembly 115 is not in the frame contact position 150.

With reference to FIG. 10, a method for controlling the operation of the attachment coupler 160 coupled to the boom assembly 115 of the work vehicle 10 is disclosed. The work vehicle 10 may be a compact track loader 20 or a skid steer (not shown). In Step 330, the method comprises providing the attachment 215 coupled to the attachment coupler 160. The attachment 215 may be a dozer blade 225 or a bucket 227. The method comprises providing the electronic data processor 275 communicatively coupled to the boom actuator 130 configured to move the boom assembly 115, the attachment coupler actuator 170 configured to move the attachment coupler 160, and the attachment actuator 230 configured to rotate the attachment 215 relative to the attachment coupler 160.

In Step 335, the method further comprises generating the boom signal 260 indicative of the position of the boom assembly 115 with the boom sensor 255.

In Step 340, the method comprises generating the attachment signal 270 indicative of the position of the attachment coupler 160 with the attachment coupler sensor 265.

In Step 345, the method further comprises receiving the operator input 85 from the operator input device 45 configured for receiving the operator input 85 in the first mode 95 or the second mode 100. The operator input 85 in the first mode 95 or the dozer control mode 110 comprises at least one of the tilt forward command 290, the tilt rearward command 295, the rotate right command 300, or the rotate left command 305, and the operator input 85 in the second mode 100 comprises at least one of the boom lower command 310, the boom raise command 315, the tilt forward command 290, or the tilt rearward command 295.

In Step 350, the method comprises receiving the boom signal 260, the attachment signal 270, and the operator input 85 with the electronic data processor 275.

In Step 355, the method further comprises providing the computer readable storage medium 280 comprising machine readable instructions 285 that, when executed by the electronic data processor 275, cause the electronic data processor 275 to receive the operator input 85 and, in the first mode 95 or the dozer control mode 110, for the tilt forward command 290, command the boom actuator 130 to move the boom assembly 115 to the frame contact position 150 and then command the attachment coupler actuator 170 to move the attachment coupler 160 towards the lower position 175. For the tilt rearward command 295, command the attachment coupler actuator 170 to move the attachment coupler 160 towards the upper position 180 and then command the boom actuator 130 to move the boom assembly 115 towards the raised position 155. For the rotate right command 300, command at least one attachment actuator 230, coupled to the attachment 215 and configured to rotate the attachment 215 relative to the attachment coupler 160, to rotate the attachment 215 towards the right 70. For the rotate left command 305, command the attachment actuator 230 to rotate the attachment 215 towards the left 65. In the second mode 100, for the boom lower command 310, command the boom actuator 130 to move the boom assembly 115 towards the frame contact position 150. For the boom raise command 315, command the boom actuator 130 to move the boom assembly 115 towards the raised position 155. For the tilt forward command 290, command the attachment coupler actuator 170 to tilt the attachment coupler 160 towards the lower position 175. For the tilt rearward command 295, command the attachment coupler actuator 170 to tilt the attachment coupler 160 towards the upper position 180.

With reference to FIG. 11, an alternative method for controlling the operation of the attachment coupler 160 coupled to the boom assembly 115 of the work vehicle 10 is disclosed. In Step 360, the method comprises providing an attachment 215 coupled to the attachment coupler 160. The method comprises providing an electronic data processor 275 communicatively coupled to the boom actuator 130 configured to move the boom assembly 115, an attachment coupler actuator 170 configured to move the attachment coupler 160, and an attachment actuator 230 configured to rotate the attachment 215 relative to the attachment coupler 160.

In Step 365, the method further comprises generating the boom signal 260 indicative of the position of the boom assembly 115 with the boom sensor 255.

In Step 370, the method comprises generating the attachment signal 270 indicative of the position of the attachment coupler 160 with the attachment coupler sensor 265.

In Step 375, the method further comprises receiving the operator input 85 from the operator input device 45 configured for receiving the operator input 85 in the first mode 95 or the second mode 100. The operator input 85 in the first mode 95 comprises at least one of the tilt forward command 290, the tilt rearward command 295, the rotate right command 300, or the rotate left command 305, and the operator input 85 in the second mode 100 comprises at least one of the boom lower command 310, the boom raise command 315, the tilt forward command 290, or the tilt rearward command 295.

In Step 380, the method comprises receiving the boom signal 260, the attachment signal 270, and the operator input 85 with the electronic data processor 275.

In Step 385, the method further comprises providing the computer readable storage medium 280 comprising machine readable instructions 285 that, when executed by the electronic data processor 275, cause the electronic data processor 275 to receive the operator input 85 and, in the first mode 95, for the tilt forward command 290, command the boom actuator 130 to move the boom assembly 115 to the frame contact position 150 and then command the attachment coupler actuator 170 to move the attachment coupler 160 to the predetermined lower position 200 while preventing the attachment coupler 160 from moving to the lower position 175, for the tilt rearward command 295, command the attachment coupler actuator 170 to move the attachment coupler 160 to the predetermined upper position 205 while preventing the attachment coupler 160 from moving to the upper position 180 and then command the boom actuator 130 to move the boom assembly 115 to the raised position 155, for the rotate right command 300, command the attachment actuator 230 to rotate the attachment coupler 160 towards the right 70, for the rotate left command 305, command the attachment actuator 230 to rotate the attachment coupler 160 towards the left 65 and, in the second mode 100, for the boom lower command 310, command the boom actuator 130 to move the boom assembly 115 lower, for the boom raise command 315, command the boom actuator 130 to move the boom assembly 115 higher, for the tilt forward command 290, command the attachment coupler actuator 170 to tilt the attachment coupler 160 forward, for the tilt rearward command 295, command the attachment coupler actuator 170 to tilt the attachment coupler 160 rearward.

What is claimed is:

1. A work vehicle comprising:

a frame;

at least one ground engaging device coupled to the frame and configured to support the frame above a surface;

a boom assembly coupled to the frame, the boom assembly configured to move from a frame contact position to a raised position;

at least one boom actuator coupled to the boom assembly and configured to move the boom assembly;

an attachment coupler coupled to the boom assembly, the attachment coupler configured to move from a lower position to an upper position;

at least one attachment coupler actuator coupled to the attachment coupler and configured to move the attachment coupler;

an attachment coupled to the attachment coupler;

an attachment actuator coupled to the attachment and configured to rotate the attachment relative to the attachment coupler;

a boom sensor configured to generate a boom signal indicative of a position of the boom assembly;

an attachment coupler sensor configured to generate an attachment signal indicative of a position of the attachment coupler;

an operator input device configured for receiving an operator input in at least one of a first mode and a second mode;

an electronic data processor communicatively coupled to the boom actuator, the attachment coupler actuator, the attachment actuator, the boom sensor, the attachment coupler sensor, and the operator input device, the electronic data processor configured to receive the boom signal, the attachment signal, and the operator input; and a computer readable storage medium comprising machine readable instructions;

wherein the operator input in the first mode comprises at least one of a tilt forward command, a tilt rearward command, a rotate right command, or a rotate left command, and the operator input in the second mode comprises at least one of a boom lower command, a boom raise command, the tilt forward command, or the tilt rearward command, and the machine readable instructions, when executed by the electronic data processor, cause the electronic data processor to:

receive the operator input and, in the first mode, for the tilt forward command, command the boom actuator to move the boom assembly to the frame contact position and then command the attachment coupler actuator to move the attachment coupler to a predetermined lower position while preventing the attachment coupler from moving to the lower position, for the tilt rearward command, command the attachment coupler actuator to move the attachment coupler to a predetermined upper position while preventing the attachment coupler from moving to the upper position and then command the boom actuator to move the boom assembly to the raised position, for the rotate right command, command the attachment actuator to rotate the attachment coupler towards the right, for the rotate left command, command the attachment actuator to rotate the attachment coupler towards the left and, in the second mode, for the boom lower command, command the boom actuator to move the boom assembly lower, for the boom raise command, command the boom actuator to move the boom assembly higher, for the tilt forward command, command the attachment coupler actuator to tilt the attachment coupler forward, and for the tilt rearward command, command the attachment coupler actuator to tilt the attachment coupler rearward.

2. The work vehicle of claim 1, wherein the work vehicle is a compact track loader, the attachment is a dozer blade, and the first mode is a dozer control mode.

3. The work vehicle of claim 1, wherein the boom actuator is at least one of a hydraulic cylinder or an electric actuator and the attachment coupler actuator is at least one of a hydraulic cylinder or an electric actuator.

4. The work vehicle of claim 1 , further comprising a mode selection device communicatively coupled to the operator input device and configured to switch between the first mode and the second mode.

5. The work vehicle of claim 1, wherein the operator input device is a joystick and in the first mode the joystick is manipulated forward for the tilt forward command, manipulated rearward for the tilt rearward command, manipulated right for the rotate right command, and manipulated left for the rotate left command, and in the second mode the joystick is manipulated forward for the boom lower command, manipulated rearward for the boom raise command, manipulated right for the tilt forward command, and manipulated left for the tilt rearward command.

6. The work vehicle of claim 1, wherein at the predetermined lower position, a cutting edge of the attachment is at a desired cutting edge position.

7. The work vehicle of claim 1, wherein at the predetermined upper position, a cutting edge of the attachment is at a desired material pushing position.

8. The work vehicle of claim 1, wherein an angle of a cutting edge of the attachment relative to the frame is maintained from the predetermined lower position to the predetermined upper position.

9. The work vehicle of claim 1, wherein the electronic data processor is configured to turn off an automatic blade control mode when the boom assembly is not in the frame contact position.

10. The work vehicle of claim 1, further comprising an automatic blade control mode.

11. A method for controlling the operation of an attachment coupler coupled to a boom assembly of a work vehicle, the method comprising:

providing an electronic data processor communicatively coupled to a boom actuator configured to move the boom assembly, an attachment coupler actuator configured to move the attachment coupler, and an attachment actuator coupled to an attachment, which is coupled to the attachment coupler, and configured to rotate the attachment relative to the attachment coupler;

generating a boom signal indicative of a position of the boom assembly with a boom sensor;

generating an attachment signal indicative of a position of the attachment coupler with an attachment coupler sensor;

receiving an operator input from an operator input device configured for receiving the operator input in at least one mode, the operator input in a first mode comprises at least one of a tilt forward command, a tilt rearward command, a rotate right command, or a rotate left command, and the operator input in a second mode comprises at least one of a boom lower command, a boom raise command, the tilt forward command, or the tilt rearward command;

receiving the boom signal, the attachment signal, and the operator input with the electronic data processor; and providing a computer readable storage medium comprising machine readable instructions;

wherein the machine readable instructions, when executed by the electronic data processor, cause the electronic data processor to receive the operator input and, in the first mode, for the tilt forward command, command the boom actuator to move the boom assembly to the frame contact position and then command the attachment coupler actuator to move the attachment coupler to a predetermined lower position while preventing the attachment coupler from moving to the lower position, for the tilt rearward command, command the attachment coupler actuator to move the attachment coupler to a predetermined upper position while preventing the attachment coupler from moving to the upper position and then command the boom actuator to move the boom assembly to the raised position, for the rotate right command, command the attachment actuator to rotate the attachment coupler towards the right, for the rotate left command, command the attachment actuator to rotate the attachment coupler towards the left and, in the second mode, for the boom lower command, command the boom actuator to move the boom assembly lower, for the boom raise command, command the boom actuator to move the boom assembly higher, for the tilt forward command, command the attachment coupler actuator to tilt the attachment coupler forward, and for the tilt rearward command, command the attachment coupler actuator to tilt the attachment coupler rearward.

12. The method of claim 3, wherein the work vehicle is a compact track loader, the attachment is a dozer blade, and the first mode is a dozer control mode.

13. The method of claim 11, wherein the boom actuator is at least one of a hydraulic cylinder or an electric actuator and the attachment coupler actuator is at least one of a hydraulic cylinder or an electric actuator.

14. A compact track loader comprising:

a frame;

at least one ground engaging device coupled to the frame and configured to support the frame above a surface;

a boom assembly coupled to the frame, the boom assembly configured to move from a frame contact position to a raised position;

at least one boom actuator coupled to the boom assembly and configured to move the boom assembly;

an attachment coupler coupled to the boom assembly, the attachment coupler configured to move from a lower position to an upper position;

at least one attachment coupler actuator coupled to the attachment coupler and configured to move the attachment coupler;

an attachment coupled to the attachment coupler, the attachment configured to rotate relative to the attachment coupler;

an attachment actuator coupled to the attachment and configured to move the attachment;

a boom sensor configured to generate a boom signal indicative of a position of the boom assembly;

an attachment coupler sensor configured to generate an attachment signal indicative of a position of the attachment coupler;

an operator input device configured for receiving an operator input in at least one of a first mode and a second mode;

an electronic data processor communicatively coupled to the boom actuator, the attachment coupler actuator, the attachment actuator, the boom sensor, the attachment coupler sensor, and the operator input device, the electronic data processor configured to receive the boom signal, the attachment signal, and the operator input; and a computer readable storage medium comprising machine readable instructions;

wherein the operator input in the first mode comprises at least one of a tilt forward command, a tilt rearward command, a rotate right command, or a rotate left command, and the operator input in the second mode comprises at least one of a boom lower command, a boom raise command, the tilt forward command, or the tilt rearward command, and the machine readable instructions, when executed by the electronic data processor, cause the electronic data processor to:

receive the operator input and, in the first mode, for the tilt forward command, command the boom actuator to move the boom assembly to the frame contact position and then command the attachment coupler actuator to move the attachment coupler to a predetermined lower position while preventing the attachment coupler from moving to the lower position, for the tilt rearward command, command the attachment coupler actuator to move the attachment coupler to a predetermined upper position while preventing the attachment coupler from moving to the upper position and then command the boom actuator to move the boom assembly to the raised position, for the rotate right command, command the attachment actuator to rotate the attachment coupler towards the right, for the rotate left command, command the attachment actuator to rotate the attachment coupler towards the left and, in the second mode, for the boom lower command, command the boom actuator to move the boom assembly lower, for the boom raise command, command the boom actuator to move the boom assembly higher, for the tilt forward command, command the attachment coupler actuator to tilt the attachment coupler forward, and for the tilt rearward command, command the attachment coupler actuator to tilt the attachment coupler rearward.

* * * * *